US009133632B2

(12) United States Patent
Patron

(10) Patent No.: US 9,133,632 B2
(45) Date of Patent: Sep. 15, 2015

(54) PLATFORM SUPPORT DEVICE FOR LIFTING LOADS OR PERSONS THE HEIGHT OF A STRUCTURE

(75) Inventor: Bruno Patron, Juigne sur Loire (FR)

(73) Assignee: FIXATOR, St. Barthelemy (FR)

( * ) Notice: Subject to any disclaimer, the term of this patent is extended or adjusted under 35 U.S.C. 154(b) by 1846 days.

(21) Appl. No.: 11/632,037

(22) PCT Filed: Apr. 29, 2005

(86) PCT No.: PCT/FR2005/001086
§ 371 (c)(1),
(2), (4) Date: Jan. 31, 2008

(87) PCT Pub. No.: WO2006/016016
PCT Pub. Date: Feb. 16, 2006

(65) Prior Publication Data

US 2008/0236944 A1 Oct. 2, 2008

(30) Foreign Application Priority Data

Jul. 12, 2004 (FR) ..... 04 07745

(51) Int. Cl.
*B66F 11/04* (2006.01)
*B66B 9/16* (2006.01)
(Continued)

(52) U.S. Cl.
CPC ... *E04G 1/20* (2013.01); *B66B 9/16* (2013.01); *B66B 9/187* (2013.01); *B66F 11/04* (2013.01)

(58) Field of Classification Search
CPC ..... B66C 23/26; B66C 23/28; B66C 23/283; E04G 3/32; E04G 3/30; E04G 1/20; E04G 1/18; B66B 9/187; B66B 9/16; B66F 11/04
USPC ..... 182/141, 130, 145, 146, 63.1, 69.6, 182/115–119, 123, 131, 142–144, 150, 223, 182/147, 148
See application file for complete search history.

(56) References Cited

U.S. PATENT DOCUMENTS 2,904,126 A 9/1959 Meng et al.
3,323,616 A 6/1967 Best
(Continued)

FOREIGN PATENT DOCUMENTS

DE 42 19 732 12/1993
EP 0 612 899 8/1994
(Continued)

OTHER PUBLICATIONS

Definition of 'cable' provided in Action The American Heritage® Dictionary of the English Language, Fourth Edition copyright © 2000 by Houghton Mifflin Company. Updated in 2009. Published by Houghton Mifflin Company. All rights reserved.*

*Primary Examiner* — Daniel Cahn
(74) *Attorney, Agent, or Firm* — Young & Thompson

(57) ABSTRACT

A device supports a platform that is used to lift loads or persons the height of a structure. Together with a platform, the device includes winch-type platform-lifting elements and modular mast-forming elements. Each mast element is attached using the load platform which can be connected to the masts by: (i) the winch-type lifting elements which can be disconnected at will from the masts, and (ii) elements for temporarily blocking the movement of the platform in relation to a modular element of each mast. In this way, when the movement of the platform is blocked, a modular element can be added to, or removed from the top of the masts in accordance with the desired platform lifting height. The platform is positioned between two modular independent masts which form a lifting and guiding path.

11 Claims, 9 Drawing Sheets

(51) Int. Cl.
*E04G 1/20* (2006.01)
*B66B 9/187* (2006.01)

(56) References Cited

U.S. PATENT DOCUMENTS

| | | | | | |
|---|---|---|---|---|---|
| 3,438,460 | A | * | 4/1969 | Solari | 182/132 |
| 3,612,219 | A | | 10/1971 | Fortner | |
| 3,936,033 | A | | 2/1976 | McElroy | |
| 4,293,054 | A | * | 10/1981 | Pieri | 182/69.6 |
| 5,159,993 | A | * | 11/1992 | St-Germain | 182/82 |
| RE34,404 | E | * | 10/1993 | Dupont et al. | 182/146 |
| 5,259,479 | A | * | 11/1993 | St-Germain | 182/146 |
| 5,992,565 | A | * | 11/1999 | Lingen | 182/141 |
| 6,095,285 | A | * | 8/2000 | St-Germain | 182/146 |
| 6,598,708 | B2 | * | 7/2003 | St-Germain et al. | 187/271 |
| 6,695,097 | B1 | * | 2/2004 | Wiklund | 182/141 |
| 2003/0213655 | A1 | * | 11/2003 | St-Germain | 187/406 |

FOREIGN PATENT DOCUMENTS

| | | |
|---|---|---|
| FR | 625 646 | 8/1927 |
| FR | 2 568 921 | 2/1986 |
| FR | 2 618 421 | 1/1989 |

* cited by examiner

PLATFORM SUPPORT DEVICE FOR LIFTING LOADS OR PERSONS THE HEIGHT OF A STRUCTURE

BACKGROUND OF THE INVENTION

1. Field of the Invention

This invention relates to a platform support device for lifting loads or individuals over the height of a structure, especially for performing work on said structure, this device comprising, in combination with a platform, platform lifting elements of the hoist type for controlling the raising level of the platform as required, combinable modular components forming the mast for reaching a desired height, each mast element being installed from the load platform that can be connected to the masts on the one hand by hoist-type lifting elements that can be disconnected from said masts as required, and on the other hand by means for temporarily immobilizing the platform relative to a modular element of each mast to allow the addition or the removal of at least one modular element at the top of the masts depending on the desired raising height of the platform, with the platform immobilized.

2. Description of the Related Art

Working over the height of facades of structures of great height is usually done using so-called suspended scaffolds. Such scaffolds are composed of a platform on which hoists are carried, the platform being suspended from the roof of the structure via fixed cables with parts connected to the roof. Such an approach is satisfactory when the roof is easily accessible and when it is possible to install anchoring elements of the cable and counterweights necessary for proper operation of the assembly. In the opposite case, the operators are powerless.

Another approach would be to position a lifting platform from the ground. However, no existing approaches are satisfactory, since they do not allow a great height to be reached in spite of using a hoist. Such is the case of the scaffolding described in the patent FR-A-2,624,173. This document describes a scaffolding of the type comprising at least one essentially vertical mast that is supported, on the one hand, on an essentially horizontal surface and, on the other hand, on an essentially vertical surface, the mast being used to anchor the cable of a hoist suited to raising or lowering, over the height of a mast, a sliding sleeve that belongs to a bracket supporting a working platform. Besides the fact that the installation of the masts is not addressed in this document, it is stated that the position of the masts that extend along one longitudinal edge of the platform comprises a limitation on the raising of the platform because they must necessarily be joined to the facade of the structure to prevent any overturning of the assembly of the structure. Thus, in this document, the masts are connected by the anchor piece shown at 9 in the figures, this anchor piece indicating the end of raising of the platform and making it impossible to use such a scaffolding for working at great heights.

The system described in the patent U.S. Pat. No. 3,323,616 is composed of a platform moving along two masts formed from telescoping modular elements requiring assembly or respectively disassembly of two masts simultaneously. Again, a sleeve belonging to a bracket supporting the working platform slides along the mast, making impossible any anchoring of the mast to the facade and necessitating synchronous movement of the platforms. Since this system cannot include means allowing its attachment to a facade, this system is not suited to working at great heights.

The system described by the patent U.S. Pat. No. 3,612,219 is composed of two ladders and one platform. The ladders are cross-braced to allow them to be kept in the upright state, thus making independent disassembly impossible from one of the ladders. The platform that is raised by the hoists carried on the platform is not guided along the ladders, making such a system unsuited for raising to great heights.

The patent FR-A-625,646 describes scaffolding whose platform is carried by independent masts that can be attached to a facade by means of buttresses. In this case, the platform is formed again by a bracket and two sleeves that each slide along a mast as shown in FIG. 1 of this patent or in the passage column 2—lines 19 to 26 of the description. Said buttresses thus constitute an obstacle to the lowering of the platform that can only be completely lowered when the masts are dismantled and the buttresses are removed. This approach therefore prevents free raising and lowering of the platform along the masts. Moreover, the platform/mast link using a sliding sleeve in the case of a structure with three masts requires synchronous movement of the entire platform.

The patent EP-A-612,899 describes a plate attached to two ladders by means of pivoting hooks hanging on the rungs of said ladders. This device allows raising and lowering of the platform along the masts, this movement being controlled by means of a hoist from within the platform or from the ground. However, the system of guiding the platform along the uprights of the ladders is not described here. During vertical movement, the platform is also made free to move horizontally, which makes this system dangerous and unsuited to working at great heights. Moreover, since the ladders are made integral by the diagonals, one of the ladders cannot be removed without removing the other.

Thus, the documents that are discussed above do not describe scaffolding that can be used at great heights, of which the platform could be moved vertically over the entire height of the uprights without adversely affecting the safety of the assembly. Moreover, none of these documents describes a device allowing asynchronous movement of two plates along two guide surfaces of the same mast.

SUMMARY OF THE INVENTION

One purpose of this invention is therefore to suggest a platform support device for lifting loads or individuals over the height of a structure whose design enables any heights, and in particular great heights, to be reached.

Another purpose of this invention is to suggest a device of the aforementioned type whose design allows optimization of the assembly and disassembly times of the masts in the case of facades of great width.

Another purpose of this invention is to suggest a device of the aforementioned type whose design allows the entire facade to be covered while limiting the number of masts that must be used.

Another purpose of this invention is to suggest a device of the aforementioned type whose design allows re-use of the bulk of the component parts of the device in a traditional assembly of the suspended platform type.

For this purpose, the object of the invention is a platform support device for lifting loads or individuals over the height of a structure, especially for performing work on said structure, this device comprising, in combination with a platform, platform lifting elements of the hoist type for controlling the raising level of the platform as required, modular components that can be assembled and that form the mast for reaching a desired height, each mast element being assembled from the load platform that can be connected to the masts at least on the one hand by hoist-type lifting elements that can be disconnected from said masts as required, on the other hand by means for temporarily immobilizing the platform relative to a modular element of each mast to allow the addition or the removal of at least one modular element at the top of the masts depending on the desired raising height of the platform, with the platform immobilized, characterized in that each platform is placed between two independent modular masts forming the raising and guide path, each mast having at least two guide paths, each able to interact with a platform to allow especially, either with the same mast, synchronous or asynchronous raising of the two platforms in parallel, or, after lateral shifting of one mast, forming a raising path again using a single mast by interaction with the mast that has remained in place, one surface that is free of any stress during movement of the platform or platforms along the mast being arranged along a generating line of each mast to allow, using suitable connecting means, coupling of mast components to the structure along which they are positioned without adversely affecting the movement of said platforms that can thus be moved over more or less the entirety of the length of said masts.

Due to the relative positioning of the platform and the masts, the masts being positioned at the ends of the platform that is thus accommodated in the space left open between said masts, there is no longer any limitation with respect to raising of the platform due to the anchoring of the masts to the structure.

Moreover, such an approach makes it possible to use the same mast as a guide and support element in the suspended state of two platforms that can be moved synchronously or asynchronously over the entire height of the mast. In this way, the number of modular elements necessary to erect the masts is limited, an especially important characteristic when the masts can reach several tens of meters. Moreover, when the device must be moved laterally along a facade, it is enough to disassemble a single mast to obtain, by interaction with the mast remaining in place, a new raising path within which the platform is located. The result is an extremely significant savings of assembly and disassembly time.

BRIEF DESCRIPTION OF THE DRAWING FIGURES

The invention will be better understood from reading the following description of embodiments, with reference to the accompanying drawings, in which.

DETAILED DESCRIPTION OF THE INVENTION

Figure 1:
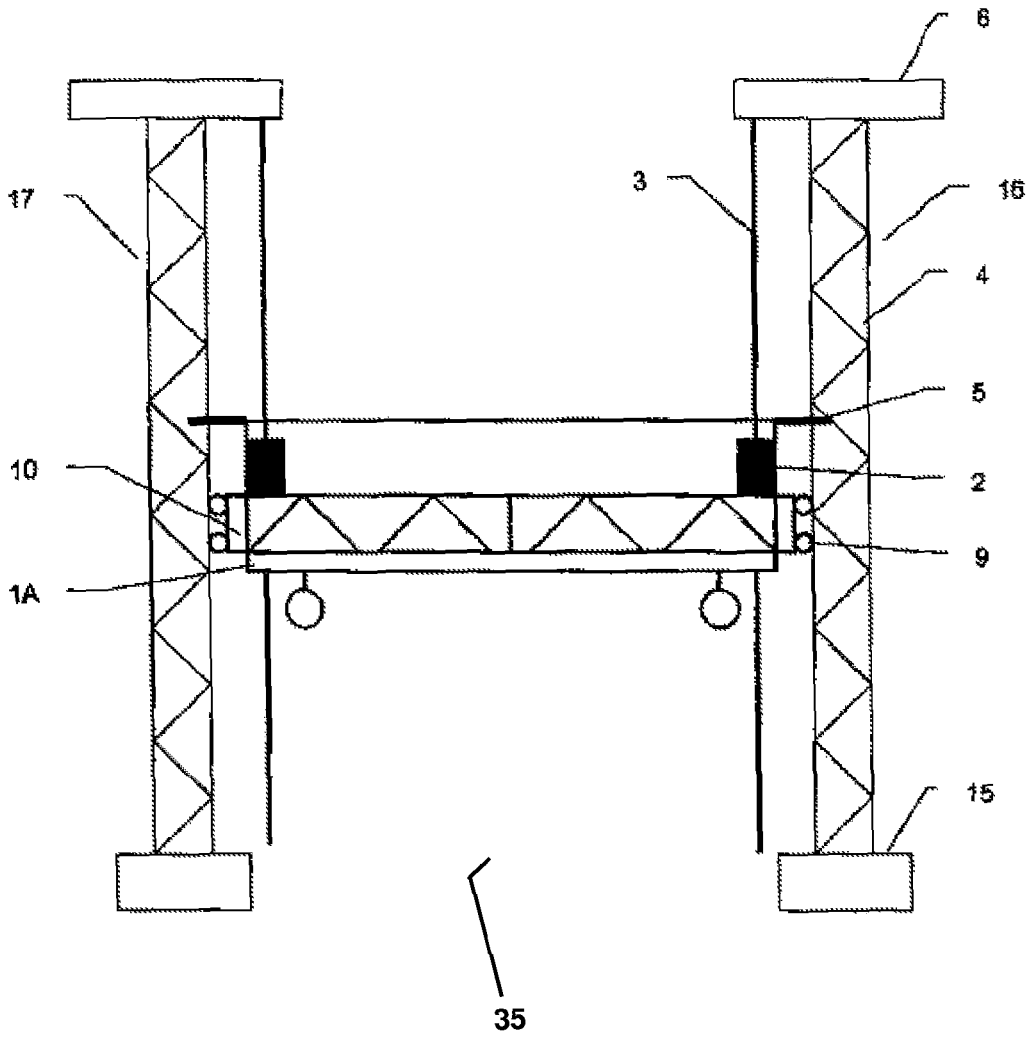
FIG. 1 shows an overall view of a device according to the invention.
Figure 2:
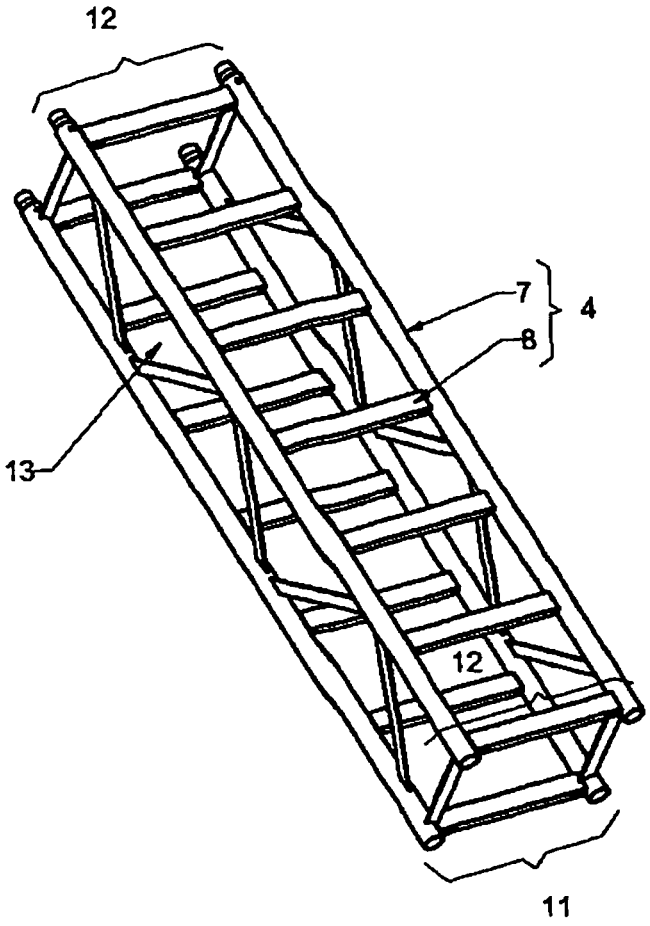
FIG. 2 shows a perspective view of one modular element of the mast.

As mentioned above, the platform support device 1A, 1B that is the object of the invention must allow individuals and/or loads to be raised to great heights, generally roughly 50 meters or more, to facilitate especially renovation of building facades. This platform support device must be able to be installed from the ground without having to use the roof of the structure. This platform support device, as mentioned above, includes in combination with a platform 1A or 1B lifting elements 2, 3 of the platform of the hoist type for controlling the raising level of the platform 1A, 1B as required, as well as modular components 4, 6 that can be assembled and that form the mast for reaching a desired height. The advantage of such a platform support device 1A, 1B is that each mast element 4 is installed from the load platform 1A, 1B that can be connected to the masts, on the one hand, by hoist-type lifting elements 2, 3 that can be disconnected from said masts as required, and, on the other hand, by means 5 for temporarily immobilizing the platform 1A, 1B relative to a modular element 4 of each mast of the hook type. Thus, in the immobilized state of the platform 1A, 1B, the temporary immobilization means 5 make it possible to add or remove at least one modular element 4, 6 at the top of the mast depending on the desired raising height of the platform 1A, 1B. When the modular element of the mast 4 has been attached to the top of the mast and the lifting element 2, 3 has been reconnected to the mast, the hoist 2 is re-actuated to allow lifting of the platform 1A, 1B as far as new temporary immobilization of the platform along the masts, then again addition of a new modular element 4 for each mast. The operation can thus be repeated until the desired height is reached. Theoretically, the platform can thus be raised to any height because the platform 1A, 1B is placed between the two modular masts 16, 17 that form a raising path 35. Thus, the anchoring of the masts 16, 17 to the facade of the structure does not hinder such a raising of the platform.

Figure 9:
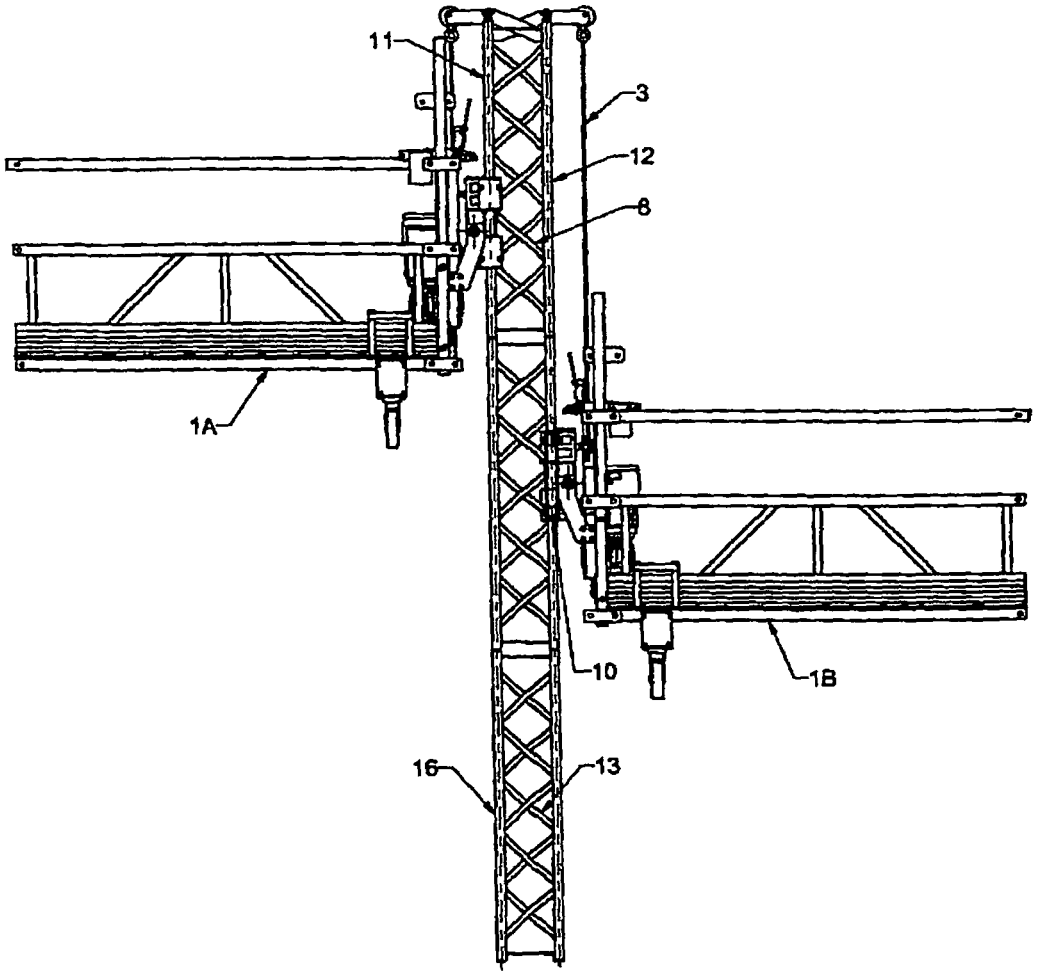
FIG. 9 shows a partial view of two platforms using the two different guide surfaces of the same mast for ensuring their guidance.
Figure 10:
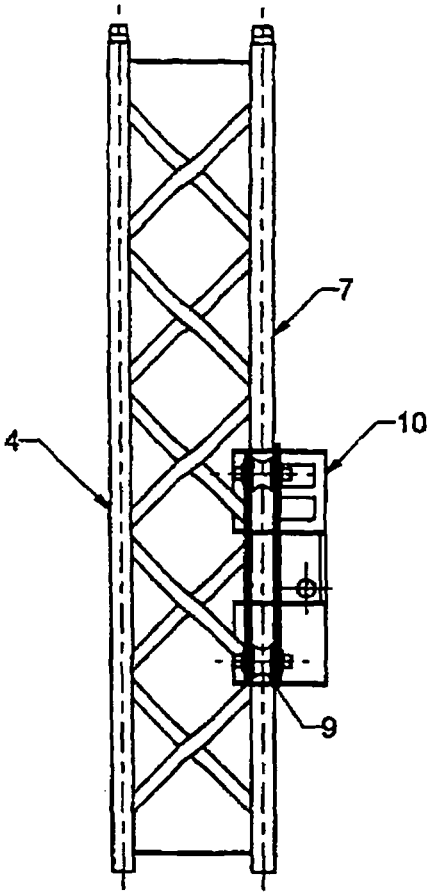
FIG. 10 shows an overall view of the system for guiding a platform along a mast.
Figure 11:
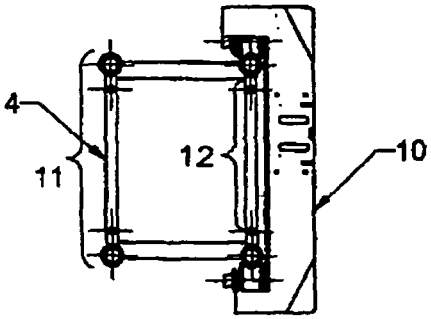
FIG. 11 shows a top view of the system for guiding a platform along a mast.

Moreover, since the system is designed to reach great heights, the number of modular elements for forming each mast is relatively large. It is therefore critical to optimize the number of pieces that must be stored for making the masts. Due to the arrangement of the masts on both sides of the ends of the platform that is generally rectangular, the masts then extending beyond the transverse edges of said platform, it is possible with the same mast to allow raising of two platforms in parallel synchronously or asynchronously as shown in FIG. 9. It is likewise possible, after lateral shifting of one mast, to form a lifting path again using a single mast by interaction with the mast that has remained in place. Finally, this platform support device 1A, 1B has the advantage of allowing re-use of the bulk of its elements for implementing a suspended platform. All of these advantages will be developed in greater detail below based on a detailed description of the platform support device.

As mentioned above, the raising level of the platform 1A, 1B can be controlled as required via lifting elements 2, 3. These lifting elements of the hoist type are composed of at least one hoist body 2 carried on the platform 1A, 1B and one cable 3 extending between the mast and platform 1A, 1B. That the hoist body 2 is carried on the platform 1A, 1B allows, during disassembly of the platform, one platform and one hoist to be ready for use for implementation of a suspended platform. The hoist body 2 is of the type with continuous passage of a cable of any length to avoid the platform 1A, 1B under certain conditions having to support the entire weight of the cable 3. In fact, in contrast to the prior art, the hoist is not a winch, in the case of which the cable is wound around the hoist body and unwinds or respectively winds up as the platform is raised. One example of such a hoist with continuous passage of a cable of any length is described especially in the patent FR-A-2,618,421. These hoists are generally composed of a pulley provided with an engagement groove and a cam designed to block the cable within said engagement groove. The cable can extend beyond this pinching zone and thus tends to come to rest on the ground, based on the hoist as shown in FIG. 1. Thus, in the case of a great cable length, the platform does not have to support the entire weight of the cable as can be the case for systems composed of a winch. This approach therefore proves especially advantageous in the case of a platform support device whose platform is designed to reach a great height.

Figure 3:
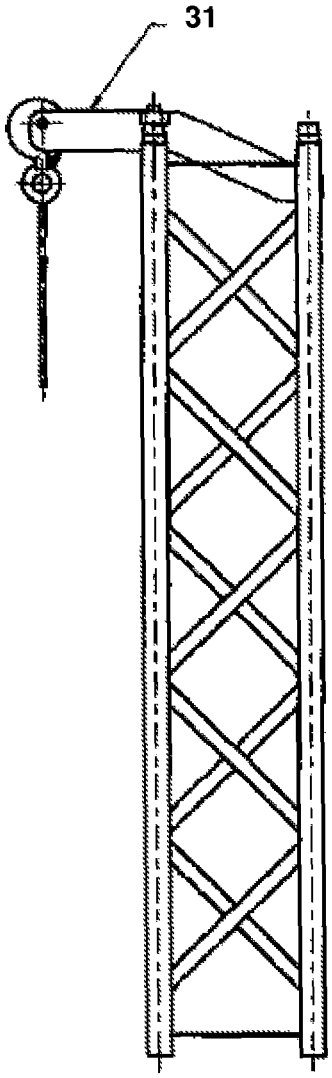
FIG. 3 shows an overall view of one element of the top of the mast joined to a modular element of the mast.

The cable 3 is connected to the mast by a modular mast element systematically comprising the top mast element 6. This top mast element 6 is shown more especially in FIGS. 3 and 4. In the illustrated example, each modular mast element 4 is composed of uprights 7, preferably at least four, interconnected by tilted or horizontal braces 8 to form a lattice structure, of which the uprights 7 are used in pairs to guide the platform 1A, 1B as it is raised along said masts 16, 17, whereas some of the braces 8 of the rail type interact with the temporary immobilization means 5 carried by the platform 1A, 1B for immobilizing the latter. The modular mast element 4 designed to be supported on the ground differs from other modular elements 4 by the fact that it is integral on one of its ends with a ground support plate 15. This plate has means for adjusting its base to ensure that the mast 16, 17 is perfectly vertical as it is raised. Each mast is made in the form of a mast that is independent relative to another mast. It is therefore automatically stable such that a mast 17 can be disassembled without having to disassemble the adjacent mast 16 with which it had been interacting.

Figure 4:
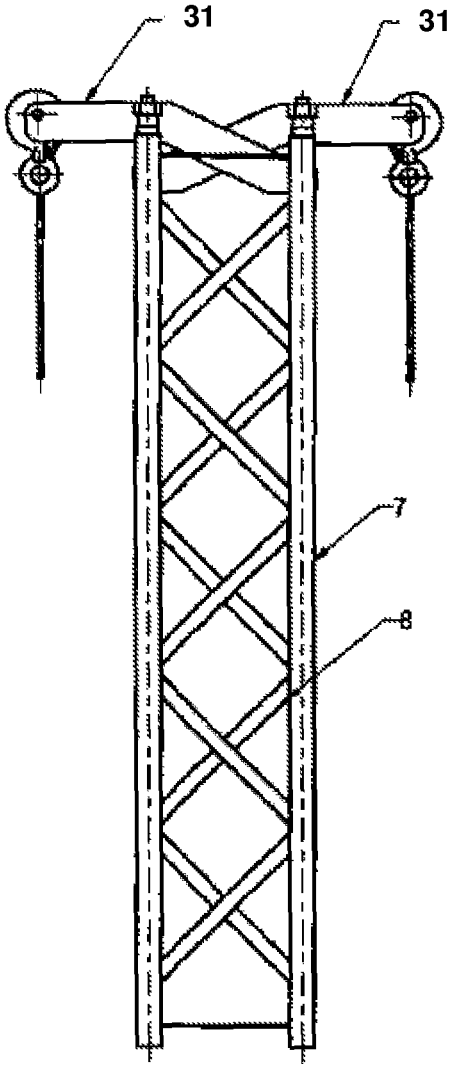
FIG. 4 shows an overall view of means for mounting two components of the top of the mast on the same modular element of the mast.

The top mast element 6, analogously to the other modular mast elements 4, is provided with uprights designed to be assembled by one of their ends to the modular elements 4. The elements 4, 6 of the modular mast 16, 17 can thus be nested by way of their uprights 7 placed end to end. A constriction can be provided to facilitate this nesting. Additional coupling elements such as bolts between the modular mast elements 4 can likewise be provided to enhance the mechanical strength of the assembly. In the examples shown, the top mast element 6 can be composed of two parallel plates interconnected by braces designed to comprise the means 13 for attachment of the cable to the top mast element 6. Tubes designed to comprise the two uprights used for assembly by nesting of the top mast element 6 in the other modular mast elements 4 are joined to this structure. The plates are elongated to form an arm ending in a hook that is open to the top to be locked under a brace of the mast bar type. These arms are shifted laterally from one top mast element 6 to another top mast element 6 to allow positioning of two top mast elements on the same mast, as shown in FIG. 4. A roller can, moreover, be provided at the level of the top of the mast to facilitate handling of mast elements. The design of each top element allows prompt and easy positioning of said element.

In another embodiment of the invention, this top mast element 6 is made symmetrical relative to the median longitudinal plane of the mast to allow especially attachment of at least two cables 3 in parallel. This arrangement is more especially advantageous when the same mast is used to raise two platforms in parallel that can thus each have a cable that can be attached to the top mast element 6. The permanent attachment of the cable to the top mast element 6 makes it possible to avoid any handling error by the operator who, for each phase of adding or removing one modular element at the top of the mast, need simply disengage the top mast element 6, then retrieve or remove a mast element 4 before repositioning this top mast element 6 without having to touch the attachment of the cable 3 to the top mast element 6. This approach increases the safety of the assembly.

The masts 16, 17 formed by assembly of modular elements of the aforementioned type comprise independent masts, inherently stable and self-supporting. Independent masts are defined as the masts of one pair of masts that can be disassembled independently of one another. Each mast is highly rigid due to its being made in the form of a beam, in contrast to the ladders of the prior art. Making the masts in the form of a tubular element, the beams being hollow and formed from a lattice structure, makes it possible to reduce the weight of the assembly. The masts each comprise preferably at least four uprights 7 interconnected by tilted or horizontal braces 8. The uprights 7 of the same mast in pairs comprise a guide path 11, 12 of a platform 1A, 1B. For the same mast, this results in the possibility of having two different guide paths 11, 12 allowing parallel and asynchronous raising of two different platforms 1A, 1B over more or less the entire height of the same mast 16, 17. These guide surfaces or guide paths 11, 12 are arranged on the mast to form, along the generating line of the mast, a free surface that allows anchoring of the mast to the facade of the structure by suitable connecting means without adversely affecting the raising and lowering of said platforms 1A, 1B. The free surface of the mast extends generally on the mast between the guide paths or surfaces 16, 17 and separates them. In summary, a mast made in the form of a tubular element with a polygonal cross-section has two surfaces, each being used to guide and raise a different platform, whereas at least some of the other surfaces of the mast that are kept free allow anchoring of the mast to a structure.

Figure 6:
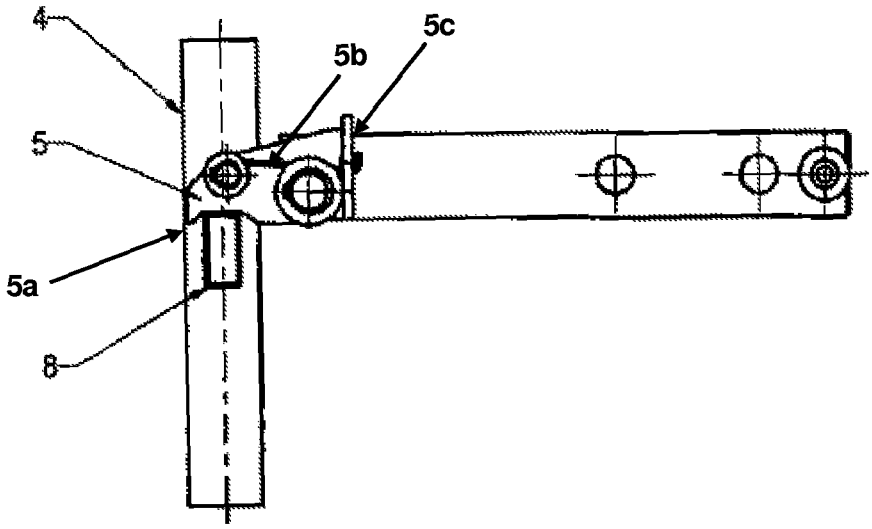
FIG. 6 shows an overall view of the means for temporarily immobilizing the platform along the mast in a position guaranteeing immobilization of the platform.
Figure 7:
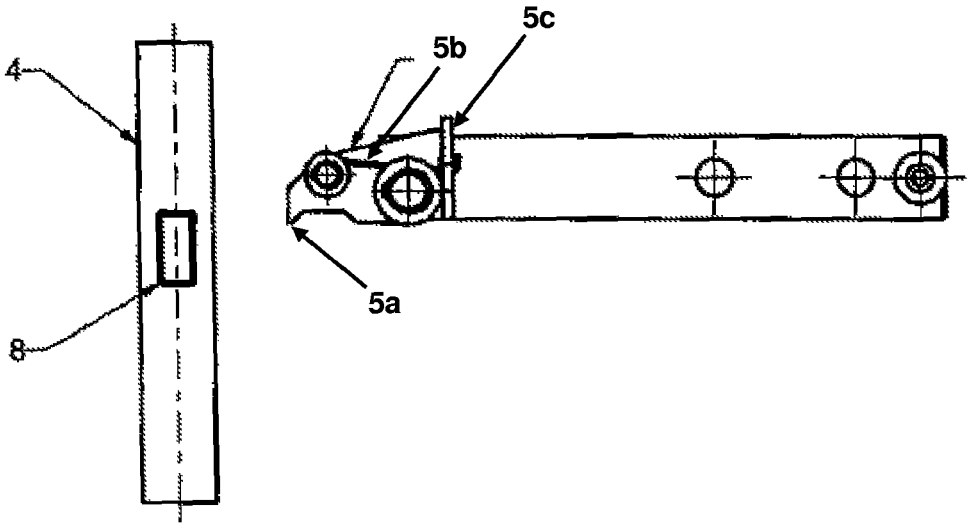
FIG. 7 shows an overall view of the means for temporarily immobilizing the platform along the mast in a position allowing the movement of the platform.
Figure 8:
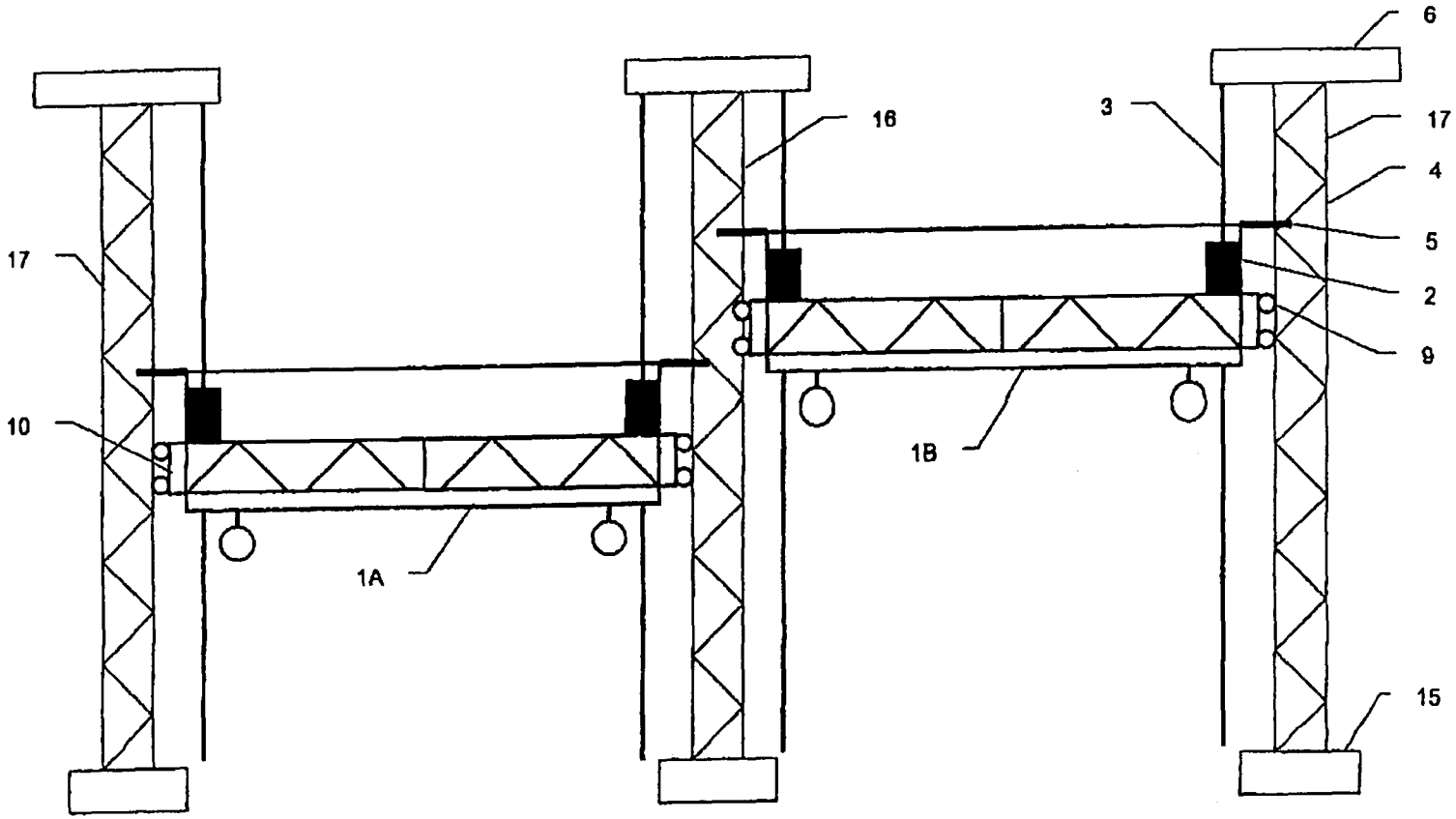
FIG. 8 shows an overall view of two devices positioned along a facade.

As the masts are raised by addition of modular mast elements 4, during the addition phase it is necessary to temporarily immobilize the platform 1A, 1B. The platform 1A, 1B can be temporarily immobilized along the masts in different ways; this is necessary to allow the addition or the removal of one element of the mast. In the embodiment shown in FIG. 6, the temporary immobilization means 5 are composed of spring-loaded 5*b* hooks 5*a*, these hooks 5*a* forming a retractable catch during lifting of the platform 1A, 1B and hooking on the mast elements 4 when the platform 1A, 1B is being lowered. These hooks are carried by a plate 5*c* connected at the level of the base of the platform. This plate 5*c* can be easily removed or retracted to allow removal of these elements, in particular during use in the form of a platform suspended from the platform of the system. During phases of raising the platform along the masts, the hooks retract automatically and the spring 5*b* moves them into a position in which they are locked on the bars 8 that form the brace between two mast uprights. During the phases of removal of a modular mast element, these phases being implemented especially during dismantling of the device, the hooks are manually retracted between two phases of removal of the modular mast elements 4 and are then re-attached to come into a position in which they lock the platform on the masts and thus allow the removal of one mast element. That is, the hooks forming the catch are manually retracted between two phases of removal of the modular mast elements, these phases being implemented especially during disassembly of the device.

Figure 5:
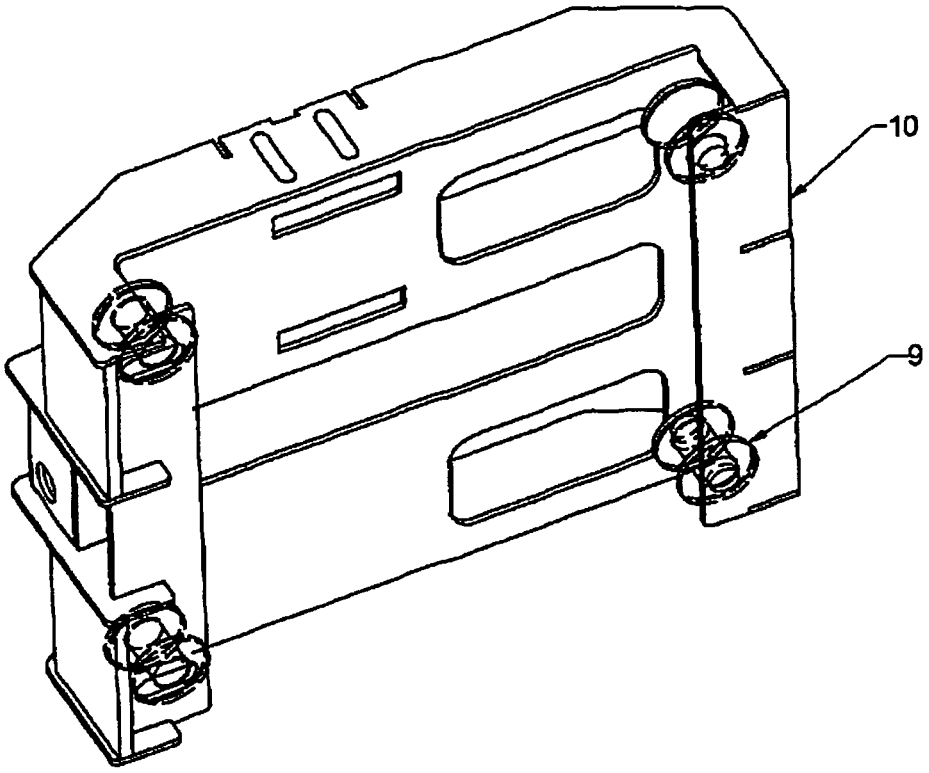
FIG. 5 shows a perspective view of means for guiding the platform of the mast.

During all phases of operation of the platform, the latter is guided in rolling or sliding contact along the masts 16, 17. The means of guiding a platform 1A, 1B along a mast are composed of, for example, rollers 9, preferably grooved, carried by a support 10 that can be removably connected to the platform 1A, 1B. The grooved rollers 9 of one support thus roll along two uprights 7 of the mast being used to form a guide path 11 or 12 of the mast. One embodiment of the guide means is provided in FIG. 5.

Quite obviously, the same platform comprises two supports 10 that are equipped with rollers 9, each support 10 interacting with a guide path 11 or 12 of a mast 16, 17. The rollers that form rolling support contact elements could be replaced by contact support guide elements sliding along said uprights without exceeding the scope of the invention. The fact that the support 10 of the roller holders 9 can be joined by simple bolting to the platform allows easy dismantling of this assembly again to allow re-use of the platform in the form of a suspended platform.

In the examples shown, two pairs of rollers are provided on each of the ends of the platform, each pair of rollers interacting with a mast upright. Because each modular mast element 4 is composed of at least four uprights, it is thus possible to guide two platforms in parallel and asynchronously on the same mast.

Finally, for reasons of safety and to prevent any overturning of the platform support device, especially during raising to great heights of the masts, the mast elements 4 can be joined to the structure along which they are located especially by percussive anchoring. Thus, as raising proceeds, the operator regularly anchors the mast elements to the facade of the structure. The brace elements between the mast uprights can be used for this purpose. Anchoring bars can likewise be used that are attached at one of their ends to the mast and project from the mast by the free surface 13 of the mast, to be attached by their other end to the construction. It is not absolutely necessary to anchor each modular mast element to said facade. One anchoring means can be provided for every two-three elements.

Finally, there can be an additional safety device, which is integral as the platform 1A, 1B is moved, able to keep the platform 1A, 1B in the support position on the masts in the case of breakage of the cable 3 of the hoist 2. The operation of these safety devices is controlled by the tension of the hoist cable. In the loosened state of the cable, the safety device is active, while it is inactive in the taut state of the cable.

In the examples shown, the platform is equipped with at least two safety devices, each safety device being formed by at least one movable stop 14, preferably two movable stops 14, controlled in motion by the tension of the hoist cable 3 to pass from one position supported on a mast to the loosened state of the cable to a retracted position in the taut state of the cable 3, so as to allow the platform to move freely along the mast in the taut state of the cable.

Figure 12:
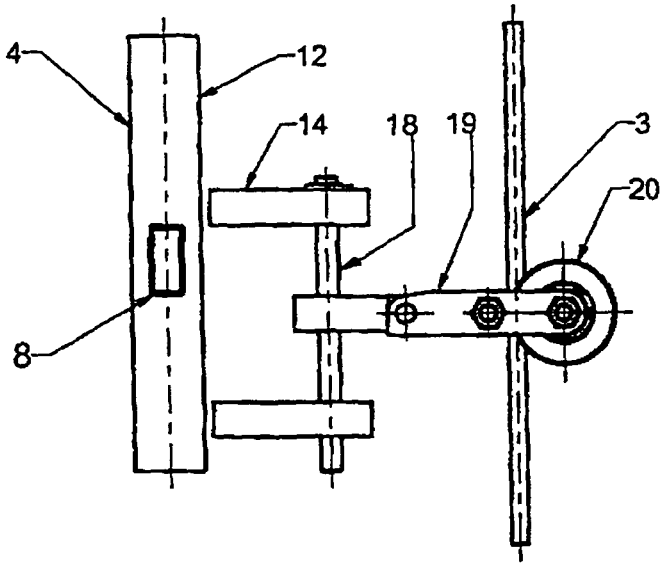
FIG. 12 shows an overall view of the safety system controlled by the tension of the cable in a taut position of said cable, allowing vertical movement of the platform.
Figure 13:
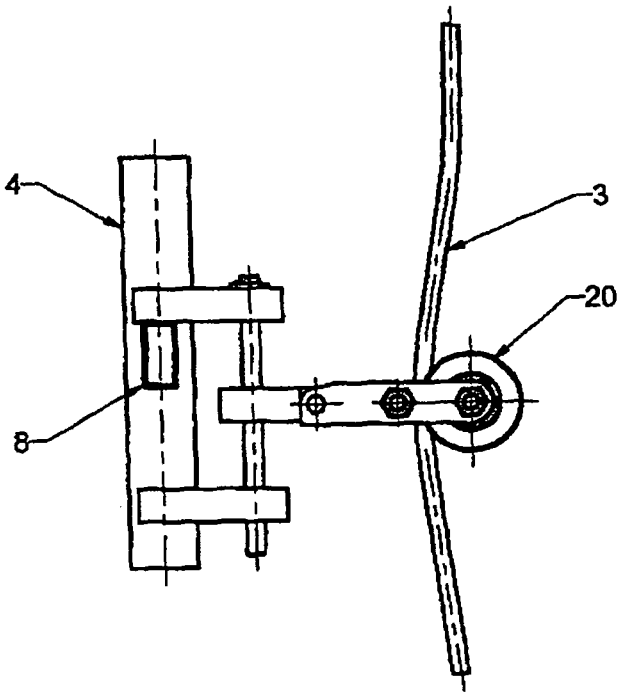
FIG. 13 shows an overall view of the safety system controlled by the tension of the cable in a loosened position of said cable, ensuring immobilization of the platform.

Thus, as FIGS. 12 and 13 illustrate, each stop 14 is connected to another stop 14 by a shaft 18. This shaft 18 is itself coupled to a yoke 19 that bears a roller 20 that delineates a passage of the hoist cable 3 with the arms of the yoke. The cable 3 in the taut state acts on the roller to induce movement of the yoke-stop assembly in the direction of the center of the platform, thus preventing the stops 14 from being supported on the braces 8 of the mast bar type. Conversely, in the loosened state of the cable 3, the stops move in the direction of the mast and encompass a rail 8, thus ensuring that the platform is held along the masts.

Due to the platform support device as described above, it becomes easy to reach great heights by means of the platform. Moreover, the phases of dismantling and repositioning of the masts along the facade are facilitated. Finally, it is possible to cover the entire facade with such platform support devices while limiting the number of masts that must be used. Such a design therefore has a large number of advantages as compared to the prior art.

The invention claimed is:

1. A device for lifting loads or individuals over a structure, the device comprising:

at least one platform;

a first mast and a second mast independently attached to the at least one platform, the first mast and the second mast being formed from a plurality of modular elements;

a plurality of hoist lifting elements adapted to be connected or disconnected from said first and second masts;

a plurality of spring-loaded hooks configured to temporarily immobilize the at least one platform relative to one of the plurality of modular elements of the masts to allow addition or removal of at least one of said plurality of modular elements with respect to the masts, each of said plurality of hooks having an indented aperture configured to saddle a brace of one of said plurality of modular elements, each of said plurality of hooks forming a retractable catch configured to pivot upon contacting a bottom surface of said brace during lifting of the at least one platform relative to the masts, and each of said plurality of hooks being configured to rest on one of the plurality of modular elements in order to prevent lowering of the at least one platform with respect to the masts, each of said plurality of hooks being connected to a horizontal bar having a major longitudinal axis configured to move horizontally between the masts into an extended and retracted position, said extended position being when a respective one of said hooks extends into one of the plurality of modular elements to prevent lowering of the at least one platform relative to the masts, and said retracted position being when said respective one of said hooks is positioned outside of the plurality of modular elements to allow lowering of the at least one platform relative to the masts;

each of said first and second masts respectively having at least two guide paths configured to guide the at least one platform, said masts having a free surface capable of attaching an anchor to the structure along which the first and second masts are positioned, wherein each guide path is configured to be directly connected to a single platform so as to allow synchronous and asynchronous raising of two platforms positioned on opposite sides of only one of the masts;

the at least one platform having a C-shaped support removably connected thereto, the support having a channel fitted with rollers configured to travel along each guide path of the masts; and an additional safety device comprising a roller connected to a stop element, the roller being configured to travel along a cable of the plurality of hoist lifting elements, the additional safety device configured to prevent the at least one platform from falling with respect to the masts when the cable moves into a loosened state, and the additional safety device being configured to allow the at least one platform to move freely along the masts when the cable is in a taught state.

2. The device according to claim 1, wherein the hoist lifting elements comprise:

at least one hoist body carried on the at least one platform; and one cable extending between at least one of the first and second masts and the at least one platform.

3. The device according to claim 2, wherein the hoist body is adapted for continuous passage of the one cable of any length to avoid the at least one platform having to support an entire weight of the one cable.

4. The device according to claim 2, wherein the one cable is connected to at least one of the first and second masts by a top mast element of the plurality of modular elements.

5. The device according to claim 1, wherein each modular mast element of the plurality of modular elements is composed of at least two uprights interconnected by a plurality of braces to form a lattice structure, and the at least two uprights configured to form a pair of uprights which forms a guide path of said guide paths in order to guide the at least one platform while being raised along said first and second masts, and the plurality of braces includes said brace.

6. The device according to claim 1, wherein the plurality of hooks are adapted to be manually retracted to remove one of the plurality of modular elements.

7. The device according to claim 5, wherein the plurality of modular elements of the first and second masts can be nested with uprights placed end to end.

8. The device according to claim 1, wherein the plurality of modular elements are joined by percussive anchoring to the structure along which they are located.

9. The device according to claim 3, wherein the one cable is connected to a top mast element of said masts.

10. A device for lifting loads or individuals over a structure, said device comprising:

at least one platform;

a first mast and a second mast independently attached to the at least one platform, the first mast and the second mast being formed from a plurality of modular elements;

a plurality of hoist lifting elements comprising at least one hoist body carried on the at least one platform and a cable extending between the at least one platform and the masts;

a plurality of spring-loaded hooks configured to temporarily immobilize the at least one platform relative to one of the plurality of modular elements of the masts to allow addition or removal of at least one of said plurality of modular elements with respect to the masts, each of said plurality of hooks having an indented aperture configured to saddle a brace of one of said plurality of modular elements, each of said plurality of hooks forming a retractable catch configured to pivot upon contacting a bottom surface of said brace during lifting of the at least one platform relative to the masts, and each of said plurality of hooks being configured to rest on one of the plurality of modular elements in order to prevent lowering of the at least one platform with respect to the masts, each of said plurality of hooks being connected to a horizontal bar having a major longitudinal axis configured to move horizontally between the masts into an extended and retracted position, said extended position being when a respective one of said hooks extends into one of the plurality of modular elements and said retracted position being when said respective one of said hooks is positioned outside of the plurality of modular elements;

each of said first and second masts respectively having at least two guide paths configured to guide the at least one platform, said masts having a free surface capable of attaching an anchor to the structure along which the first and second masts are positioned, wherein each guide path is configured to be directly connected to a single platform so as to allow synchronous and asynchronous raising of two platforms positioned on opposite sides of only one of the masts;

the at least one platform having a C-shaped support removably connected thereto, the support having a channel fitted with rollers configured to travel along each guide path of the first and second masts; and an additional safety device comprising a roller connected to a stop element, the roller being configured to travel along the cable of the plurality of hoist lifting elements, the additional safety device configured to prevent the at least one platform from falling with respect to the masts when the cable moves into a loosened state, and the additional safety device being configured to allow the at least one platform to move freely along the masts when the cable is in a taught state.

11. A device for lifting loads or individuals over a structure, said device comprising:

at least one platform;

a first mast and a second mast independently attached to the at least one platform, the first mast and the second mast being formed from a plurality of modular elements;

a plurality of hoist lifting elements adapted to be disconnected from said first and second masts;

a plurality of spring-loaded hooks configured to temporarily immobilize the at least one platform relative to one of the plurality of modular elements of the masts to allow addition or removal of at least one of said plurality of modular elements with respect to the masts, each of said plurality of hooks having an indented aperture configured to saddle a brace of one of said plurality of modular elements, each of said plurality of hooks forming a retractable catch configured to pivot upon contacting a bottom surface of said brace during lifting of the at least one platform relative to the masts, and each of said plurality of hooks being configured to rest on one of the plurality of modular elements in order to prevent lowering of the at least one platform with respect to the masts, each of said plurality of hooks being connected to a horizontal bar having a major longitudinal axis configured to move horizontally between the masts into an extended and retracted position, said extended position being when a respective one of said hooks extends into one of the plurality of modular elements to prevent lowering of the at least one platform relative to the masts, and said retracted position being when said respective one of said hooks is positioned outside of the plurality of modular elements to allow lowering of the at least one platform relative to the masts;

each of said first and second masts respectively having at least two guide paths configured to guide the at least one platform, said masts having a free surface capable of attaching an anchor to the structure along which the first and second masts are positioned, wherein each guide path is configured to be directly connected to a single platform so as to allow synchronous and asynchronous raising of two platforms positioned on opposite sides of only one of the masts;

the at least one platform having a C-shaped support removably connected thereto, the support having a channel fitted with rollers configured to travel along each guide path of the first and second masts; and an additional safety device comprising a roller connected to a stop element, the roller being configured to travel along a cable of the plurality of hoist lifting elements, the additional safety device configured to prevent the at least one platform from falling with respect to the masts when the cable moves into a loosened state, and the additional safety device being configured to allow the at least one platform to move freely along the masts when the cable is in a taught state.

* * * * *